United States Patent [19]

Vantini et al.

[11] 4,236,986

[45] Dec. 2, 1980

[54] APPLYING ANNEALING SEPARATORS TO ORIENTED GRAIN ELECTRICAL STEEL SHEET

[75] Inventors: Nereo Vantini; Paolo Marini, both of Rome, Italy

[73] Assignee: Centro Sperimentale Metallurgico S.p.A., Rome, Italy

[21] Appl. No.: 46,422

[22] Filed: Jun. 7, 1979

[30] Foreign Application Priority Data

Jun. 9, 1979 [IT] Italy ..... 49791 A/78

[51] Int. Cl.[3] ..... C25D 13/02; C25D 13/10; C25D 13/16

[52] U.S. Cl. ..... 204/181 N; 204/181 C

[58] Field of Search ..... 204/181 C, 181 N

[56] References Cited

U.S. PATENT DOCUMENTS 3,331,762 7/1967 Jackson ..... 204/181 N

*Primary Examiner*—Howard S. Williams

*Attorney, Agent, or Firm*—Young & Thompson

[57] ABSTRACT

The coating of oriented grain steel sheet with annealing separators is carried out from a suspension of annealing separator in a suspension medium having a non-aqueous base, preferably commercial ethyl alcohol containing limited and controlled amounts of water, e.g. below 5%, by continuously passing steel sheet as the cathode of an electrophoretic cell, between a pair of electrodes placed in, and near the free surface of the bath, symmetrically with respect to the steel sheet.

7 Claims, 1 Drawing Figure

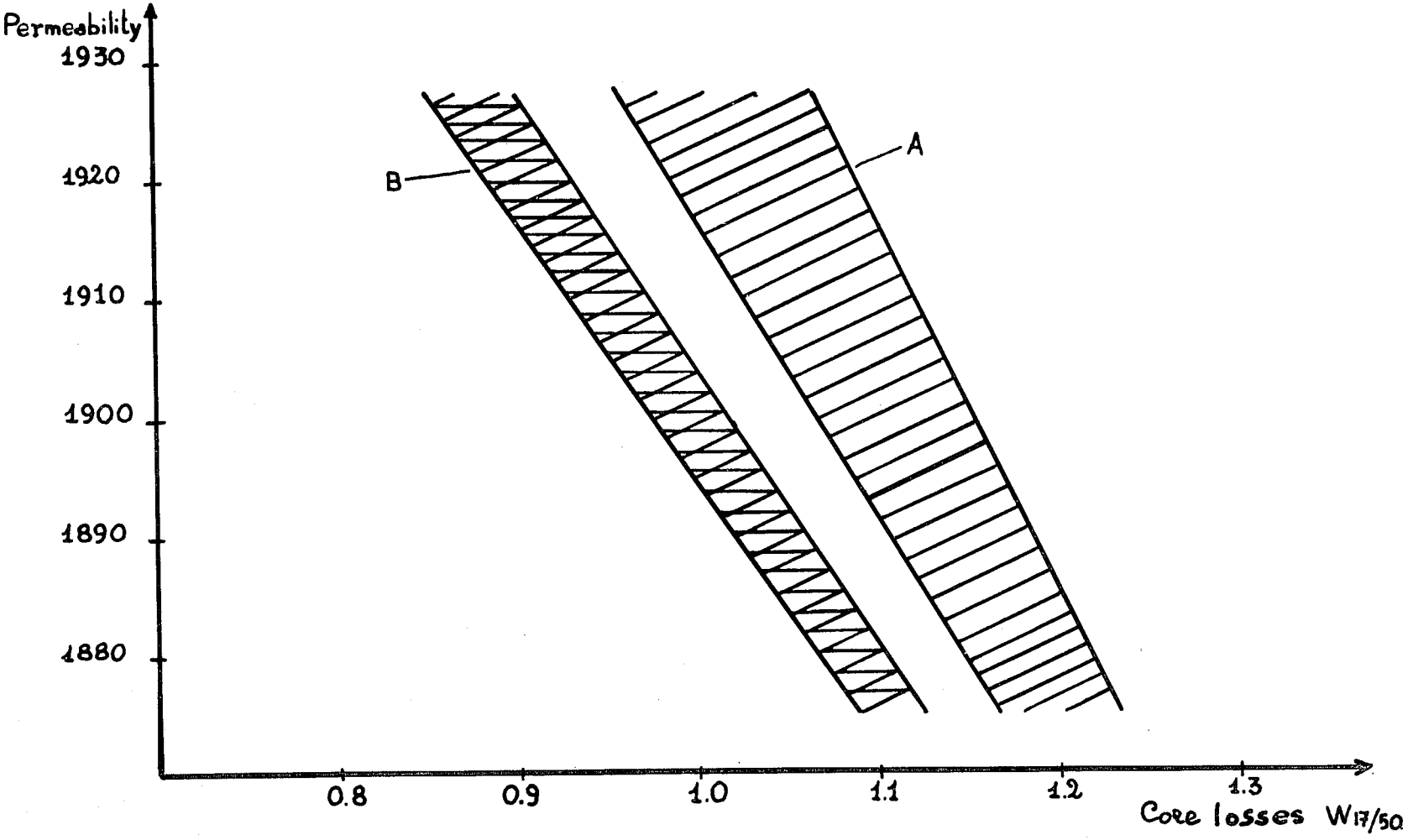
Permeability
1930
1920
1910
1900
1890
1880
0.8
0.9
1.0
1.1
1.2
1.3
Core losses W17/50
A
B

APPLYING ANNEALING SEPARATORS TO ORIENTED GRAIN ELECTRICAL STEEL SHEET

The present invention refers to an improvement in the manufacture of oriented grain electrical steel sheet. Particularly, it refers to the improvement of an important stage in the manufacture of oriented grain silicon steel sheet, having high magnetic properties, to be used in the production of transformers and other electrical equipment. The improvement of the present invention concerns the steps of the formation on the surface of said sheet of a continuous and compact deposit of annealing separator and of the subsequent transformation of at least a part of said annealing separator into a film of a complex composition generally known as "glass film" or "mill glass".

The process of manufacture of electrical silicon steel sheets is long and complex and involves, after a series of treatments which terminate with cold rolling to the final thickness required and with the thorough decarburization of the strip, an annealing operating at high temperature which, for a number of reasons well known to the experts, lasts for some ten hours. The annealing must, therefore, be performed in batch furnaces, called bell furnaces, on the strip wound in coils or cut into sheets which are stacked in bundles. The temperature reached during this annealing treatment is sufficiently high to cause, together with the products of a number of reactions which occur on the surface of the strip, the cohesion of the turns of the coils or of the sheets of the bundles. For this reason substances have been developed called annealing separators which, originally, had merely the purpose of keeping the turns or the sheets apart from one another. Later it was noted that the annealing separators could also perform the role of aiding the extraction from the strip of a number of components useful in certain ways during the preceding steps of the treatment but harmful to the final properties of the strip.

Another function of the separators has become that of reacting with the silica expelled from the strip mainly during decarburization, to form on the strip itself an adherent layer of a complex composition known generally as "glass film".

For these reasons, annealing separators having progressed, from the inert materials they once were, to materials of a reactive type, and are at present mainly comprised by magnesium oxide, with possible minor additions of other compounds.

The simplest procedure for depositing annealing separators on strip consists in preparing a suspension of it in water and in passing the strip through this suspension. This method, efficacious up to a certain time ago, has begun to show a number of important drawbacks when used with modern oriented grain silicon steel sheets, having high magnetic properties. In fact, some intrinsic defects of the method, e.g. the failure to avoid the formation of coatings having a greater thickness on the upper surface of the strip than on the lower one, although tolerable for non-oriented grain sheets or, in any case, for low quality materials, are intolerable for modern materials. But there is another very serious drawback, which is as follows:

It is well known that magnesium oxide reacts with water to form hydroxide. This water is, unfortunately, released at a relatively high temperature (about 300° C.) for example during the annealing stage in the bell furnaces and causes a series of marked disadvantages.

As experts in this field well know, the atmosphere of the furnace during annealing must be strictly controlled, in particular as far as its humidity is concerned: in fact, only very narrow limits are tolerable for the dew point of the gas entering the furnace, which is usually hydrogen. It is easy to imagine how the water released by the annealing separator may alter the dew point of the atmosphere inside the furnace and how the alteration may be much greater precisely at the point where the water has been released, namely between the tight turns of the coils, where the circulation of the gas which forms the atmosphere of the furnace is obviously extremely limited. The pronounced local rise of the dew point causes alterations of the reactions which must occur at the surface of the strip, and the surface oxidation of the strip itself, with serious damage to the quality of the final product. In this respect, it must not be overlooked that modern materials, with a silicon content of about 3%, thickness of strip around 0.3 mm, permeability over 1.9 Tesla and core losses of less than 1.1 W/kg, fall sufficiently near to the maximum theoretical limits of quality, so that final variations, small in absolute terms, in the permeability values and losses can lead to important variations in the quality of the product.

To prevent these disadvantages, it has been proposed to increase the temperature of calcination of the magnesium oxide to reduce its reactivity; however, this temperature can not be extremely high since it increases to an intolerable extent the size of the particles. Moreover, with the usual periods of contact of the magnesia with the water, it is impossible to avoid the formation of a certain quantity of hydroxide. It was then suggested, by a number of parties, to keep the temperature of the suspension of magnesia in water at very low levels, below 5°–10° C., and to replace the suspension frequently. This type of action, however, even if it is of considerable efficacy, cannot but complicate and increase the cost of a process which is already complex and expensive enough. The importance of the surface layer of the strip will be more obvious if one considers that evenness and cleanness of the surface itself are fundamental factors for the formation of a good glass film which, on the other hand, cannot be continuous and adherent to the metallic sublayer if on this sublayer there is some iron oxide previously formed by the water left by the annealing separator.

Such a defect of the glass film prevents the tensioning effect of the subsequent coating having a low thermal expansion coefficient, which otherwise would reduce the core losses.

Still another leading cause of downgrading the product is the stained and uneven aspect which the strip takes on because of its surface oxidation.

It is therefore obvious that a large quantity of hydration water in the green deposit of the annealing separator is a source of marked difficulties which up to now have been only partially avoided.

Efforts to obtain deposits of annealing separators by non-aqueous means have not produced satisfactory results, especially as in order to guarantee the adhesion of the deposit to the substrate it was found necessary to use binders of the organic type.

An attempt, described in Italian Patent No. 652,122 having a United States priority date of 1960, to obtain adhering deposits by electrostatic means in air seemed at the outset promising, but, unfortunately, has not led, at least as far as we are aware, to any practical application at an industrial level.

During research carried out by the present applicants, an endeavor was made to control in a precise and reproducible way the quantity of water which reacts with the magnesium oxide, with the aim of ascertaining its influence on the final quality of the sheet.

In this research, one of the methods chosen to bring about the depositing of the magnesia was electrophoresis in an organic medium with various additions of water. This method has enabled the degree of hydration of the magnesia to be controlled very well, and has permitted the isolation of the effect of the degree of hydration from the effect of the thickness of the deposit, which has invariably been found to be extremely constant.

However, besides these results, truly important for understanding the phenomena connected with the quality of the magnetic sheet, another even more important result has been obtained, namely that the deposits of magnesia obtained by electrophoretic methods are surprisingly adherent to the ferrous substrate even without the use of binders.

A thorough examination over many years of the literature in the electrophoretic field had, in fact, led to the belief that the deposits obtained by electrophoretic methods without the help of organic binders were only possible on those pieces which did not undergo bending, rubbing or contact with other bodies, or other types of handling, before being subjected to the final treatment of consolidating the deposit.

In fact, since 1955 Shyne and others in "Plating", page 1255 et seq. stated: "The coatings resulting after drying are not structural in themselves, since it is necessary to bind the particles among one another and to the sublayer". Similar concepts were repeated over the following years: "Using additives it is possible to obtain suspensions which form adherent coatings . . . ; Zein . . . is an excellent binder and the coatings which contain it have a 'green' strength of such force that to remove them from the sublayer mechanical scraping must be used" (Gutierrez and others, Journal of Electrochemical Society, 1962, page 923 et seq.) Again Pearlstein and others affirm that the deposits obtained without binders "are easily damaged during handling operations . . . several binders may be added . . . to improve the cohesion of the deposit" (Journal of the Electromechanical Society, 1963, page 843 et seq.) Finally, Andrews states that "the dusty deposit obtained by electrophoresis is normally held together by forces of physical type, and thus it needs some form of consolidation . . . before it is possible to use it" (Metal Finishing Journal, 1970, October, page 322 et seq.), and states in another publication (Proceedings of the British Ceramic Society, 12, (3), 1969, page 211 et seq.), that a number of shellac or nitrocellulose type binders, are necessary to enable the pieces produced to be handled without damaging the coating.

The electrophoretic technique, even if it could potentially give a number of advantages, has not, up to now, been used for the purpose of depositing annealing separators on silicon steel sheets, due to lack of information on the continuous electrophoretic coating of strips and the need envisaged in the art to adopt organic binders. Silicon steel sheets for magnetic uses, when covered with the annealing separators, have already undergone a decarburization treatment which has reduced the carbon content to very low levels (generally between 20 and 40 parts per million) necessary to obtain the high magnetic properties required. It is now readily understood why organic binders of the zein, shellac types and derivatives of cellulose, etc., are highly undesirable in this field, since during the annealing of the coils in the bell furnaces, they would cause a recarburizing of the strip, with obvious deterioration of the quality.

The present invention overcomes these drawbacks by providing a procedure for the deposition of oxides, for example magnesium oxide, which is able to ensure the continuous production of adherent deposits, free from organic binders and with a strictly controlled quantity of hydration water.

According to the present invention, in a process for the production of high quality oriented grain electrical steel sheet which includes, after preliminary treatments culminating with cold rolling to the final thickness desired, the steps of subjecting the cold-rolled sheet to a continuous decarburization treatment, of coating the decarburated and pickled strip with a composition of annealing separator, of coiling the strip thus coated and dried into coils or of cutting it into sheets and forming tight bundles of them, and of subjecting these coils or these bundles to an annealing treatment at high temperature in bell furnaces, with the aim of eliminating from the strip some components harmful to the final quality, of causing the secondary recrystallization desired and of forming on the surface of the strip an adhering and continuous layer of complex composition known as "glass film", the improvement is introduced which consists in the combination in sequence of the following steps:

preparing a dispersion of the annealing separator in a liquid dispersion medium of non-aqueous base, said annealing separator and said dispersion medium having a known and controlled water content;

placing in said dispersion a pair of electrodes; said electrodes having their upper edge at a distance from the free surface of the dispersion less than 100 mm;

continuously immersing the sheet of decarburized steel in said dispersion; making it pass, as it leaves the dispersion, between the said electrodes placed in pairs;

applying between said decarburized steel sheet and said electrodes an electric field falling between 30 and 60 V/cm;

applying to the surface of the steel sheet, as it leaves the dispersion coated with a continuous layer of the composition of annealing separator, during the passage between said paired electrodes, a gaseous stream to remove from said continuous layer said liquid dispersion medium;

coiling, without further intermediate treatments, the strip into a coil, to be sent for annealing in a bell furnace.

The accompanying drawing is a diagram of core losses versus permeability, for the prior art (A) and for the present invention (B).

The improvement according to the present invention is further characterized by the fact that the dispersion medium is quite inexpensive and is comprised by commercial ethyl alcohol and water. Even if it is advisable that the initial water content of the alcohol should be the lowest possible, for example, below 5%, for the purposes of the present invention it is possible for this content to increase even to a considerable degree, without damaging the quality of the deposit which is obtained and of the final product. Should the ambient conditions and those of the process be such as to involve a continuous, even if small addition of water, a fairly high water content could be reached in the dispersion such as to cause the development of hydrogen on the strip to be coated; in this case, and still without harm to the process, it is possible to add to the dispersion medium some easily reducible substances, such as aldehydes or ketones, which, as is well known, react instantly with the hydrogen preventing the formation of bubbles.

The annealing separator, consisting essentially of calcined magnesium oxide, with the possible addition of additives such as calcined boric anhydride, oxides of rare earth elements, etc. already known in this field, will preferably have ignition losses less than 5%, and will be dispersed in the dispersion medium in a quantity of between 20 and 300 g/liter; however, higher ignition losses are not harmful for the process according to this invention. According to the invention, the silicon steel strip will be passed into the dispersion consisting of the annealing separator and of the dispersion medium and will be conveyed along the midplane of the two electrodes, which constitute the cell anode, while the cathode is formed by the steel strip itself. The suspension or dispersion is, naturally, made to circulate continuously, so that between said electrodes there is always fresh suspension. Because of the electric field established between the electrodes and the strip, the particles of annealing separator are projected toward the steel strip and adhere tenaciously to it, forming a compact, continuous and absolutely uniform layer on the surface of the strip itself.

The reasons why are still not clear, but the deposit obtained in this way has an exceptional adherence to the ferrous substrate even in the green state, so that after drying in a gas stream, the coated sheet can undergo a number of bending operations about deflecting rollers and is wound at industrial speed, the coating being neither removed nor damaged. To eliminate the coating at the "green" state it is necessary to effect a fairly strong mechanical rubbing action.

As a result of its strong adherence to the substrate, of its compactness and continuity and of the control of the amount of water it retains, the annealing separator deposited according to the invention will form, during the annealing treatment in bell furnaces, a "glass film" with truly exceptional adherence and continuity.

The quality of the "glass film" and its effect on the final quality of the sheet can be assessed in various ways.

One of the classical ways is to measure the electric insulation both on the sheet provided with the "glass film" only and on the final sheet coated with other insulating and possibly tensioning compounds. With the sole aim of comparison, we set out in Table 1 the values obtained for insulation (expressed in ohm/cm$^2$) conferred to the sheet by various types of "glass film".

TABLE 1

| Type of coating | | Insulation in ohm/cm$^2$ obtained with already known means Min. | Med. | Max. | obtained according to the invention Min. | Med. | Max. |
|---|---|---|---|---|---|---|---|
| Glass film | 1 | 0 | 0.5 | 4 | 6 | 13 | 16 |
| | 2 | 0 | 1 | 5 | 4 | 15 | 20 |
| | 3 | 0 | 1 | 4 | 8 | 12 | 15 |
| | 4 | 0 | 2 | 4 | 8 | 15 | 18 |
| | 5 | 0 | 1 | 6 | 6 | 12 | 18 |
| Glass film + phosphate coating | 1 | 7 | 19 | 120 | 50 | 150 | 800 |
| | 2 | 7 | 20 | 130 | 50 | 130 | 1000 |
| | 3 | 7 | 18 | 100 | 60 | 130 | 1000 |
| | 4 | 6 | 25 | 150 | 60 | 160 | 700 |
| | 5 | 10 | 30 | 150 | 60 | 150 | 1000 |

TABLE 1-continued

| Type of coating | | Insulation in ohm/cm$^2$ obtained with already known means Min. | Med. | Max. | obtained according to the invention Min. | Med. | Max. |
|---|---|---|---|---|---|---|---|
| Glass film + tensioning phosphate coating | 1 | 20 | 130 | 500 | 150 | 800 | 1000 |
| | 2 | 20 | 120 | 1000 | 170 | 800 | 1000 |
| | 3 | 30 | 120 | 600 | 170 | 900 | 1000 |
| | 4 | 20 | 100 | 600 | 140 | 900 | 1000 |
| | 5 | 25 | 100 | 700 | 160 | 800 | 1000 |

This table shows in the left column the types of coating examined, with for each group five sets each of a thousand measurements, obtained on industrially produced sheets. The second column shows the values of the insulation obtained with sheets on which the annealing separator had been deposited with traditional means; in the third column, instead, are set out the values of insulation obtained with annealing separator deposited according to the present invention. In each case, for uniformity, the annealing separator was made up of magnesium oxide containing 4% of rare earth element oxides, and had ignition losses equivalent to 3%.

As can be seen, the present invention allows one to obtain markedly superior and less dispersed insulating values than those obtainable when traditional methods are used. It may be noted that by depositing the separator according to the presentzinvention, the insulating values obtained are comparable with those of the superior class with separator deposited conventionally: thus, for example, the insulating values of the "glass film" alone, according to the invention, can be compared with those obtainable with "glass film" from an annealing separator deposited traditionally and coated with phosphate.

Even more significant results can be obtained if the continuity of the "glass film" is measured; this continuity being evaluated (according to the method reported in "Zashchita Metallov", 11, No. 1, pages 109–111, 1975), using a small piece of sheet coated with "glass film", by exposing a 1 cm$^2$ surface of this piece as electrode in an electrolytic cell containing 100 g/l of potassium sulphocyanide, and by maintaining a constant potential of 0.5 V between this electrode and a counter-electrode of the same area. The current passing is proportional to the uncovered surface of the sheet. The results are shown in Table 2.

TABLE 2

| Type of "glass film" | Series of tests % cover 1 | 2 | 3 | 4 | 5 |
|---|---|---|---|---|---|
| Obtained by simple immersion | 75 | 72 | 60 | 66 | 86 |
| Obtained according to the invention | 93 | 96 | 95 | 96 | 90 |

For this type of test also five series of 1,000 measurements each for each type of "glass film" were made. As is seen, the percentage of cover obtained for the "glass film" obtained by separators deposited according to the invention is much greater and less dispersed than with the "glass film" obtained according to the known techniques.

Further data can be taken from the accompanying drawing, which shows the core losses in w/kg for sheets having a thickness of about 0.30 mm plotted against the permeability. The group of A values relates to sheets with traditional "glass film", whereas the group B relates to sheets coated according to the present invention. These diagrams are indicative of the continuity and adherence of the "glass film" obtained with the various methods and, accordingly, of the influence these factors exert on the efficiency of the tensioning power of the final coating.

Both Tables 1 and 2 and the accompanying drawing indicate the influence of the present invention on the quality of the sheet and not the maximum effect obtainable according to the invention since the parameters which can influence the final result are very many and mostly dependent on the plant used and on the general working conditions.

However, it is easy to understand the improvement which can be obtained, the type of sheet or composition of annealing separator and successive treatments being otherwise identical, by depositing the annealing separator on the strip according to the present invention.

In particular, with regard to the diagram attached, it may be seen that the group of core loss values obtainable is much less scattered and shows more pronounced improvements in losses with the increase of the permeability with "glass film" deriving from annealing separators deposited according to the present invention than with "glass film" from separators deposited in the traditional way. This means that not only are the values of losses obtainable according to the present invention better than those obtainable according to the prior art, permeability being equal, but also that, for a given increase in permeability there is a corresponding improvement in the value of losses of a considerably more marked kind, according to the present invention. Moreover, according to the present invention, passing, for instance, from a permeability value of 1,900 to one of 1,915, an improvement in the losses will occur, in any case, since the dispersion band is very narrow, whereas, according to the prior art, for the same increase in the value of permeability it is possible to have an improvement in the losses, but also a worsening. The dispersion band is, in fact, in this case much wider and steeper.

The advantages obtainable according to the present invention are, therefore, clear and unequivocal.

Moreover, it is possible to obtain, according to the present invention, further important advantages as follows:

As has been seen, the drying of the coated strip in the present invention is performed by blowing air over it; with this method heating in a furnace to 300°–400° C. is eliminated, since it is necessary only to have a short conduit into which is sent a current of air, which can also be heated, for example to 40°–60° C. and, in any case, for reasons of economy, to less than 100° C. Another advantage that can be obtained is that of having a single coating tank, and a smaller one too, since the deposit of the separator occurs exclusively, or virtually exclusively, in the area between the electrodes arranged in pairs. This makes the procedure simpler and permits, should this be considered necessary or advisable, also the cooling of the dispersion, with an extremely modest increase in cost, because of the small amount of dispersion to be cooled.

What is claimed is:

1. In a process for the production of oriented grain electrical steel sheet which comprises, after preliminary treatment and cold rolling to the final thickness required, the steps of subjecting the cold rolled sheet to a continuous decarburization treatment, coating the decarburized sheet with a composition of annealing separator, coiling the strip covered in this way and dried, into coils, and subjecting these coils to an annealing treatment at high temperature in a bell furnace; the improvement comprising in sequence the following steps:

preparing a dispersion of annealing separator in a non-aqueous based dispersion medium, said annealing separator and dispersion medium having a predetermined water content;

placing in this dispersion a pair of electrodes, said electrodes having their upper edge less than 100 mm from the free surface of the dispersion;

continuously immersing in this dispersion the decarburized steel strip, making it pass between the paired electrodes;

applying to said steel strip and said electrodes opposite polarities of an electrical field within the range of 30 to 600 V/cm;

applying to the surface of the steel strip, removed from the dispersion and coated with a continuous layer of the composition of annealing separator during its passage between the said electrodes, a gas stream; and coiling without further treatment the strip into coils for annealing in the bell furnace.

2. A process according to claim 1, in which said dispersion medium is commercial ethyl alcohol and water.

3. A process according to claim 2, in which said ethyl alcohol has an initial water content of less than 5%.

4. A process according to claim 3, in which said water-alcohol mixture contains aldehydes or ketones.

5. A process according to claim 1, in which the silicon steel sheet is passed between the electrodes along the midplane of the electrode pair.

6. A process according to claim 1, in which the gas stream is heated to a temperature of less than 100° C.

7. A process according to claim 6, in which the gas stream is air.

* * * * *